US007698900B2

(12) United States Patent
Chung

(10) Patent No.: US 7,698,900 B2
(45) Date of Patent: Apr. 20, 2010

(54) ICE MAKING DEVICE FOR REFRIGERATOR

(75) Inventor: Eui Yeop Chung, Seoul (KR)

(73) Assignee: LG Electronics Inc., Seoul (KR)

( * ) Notice: Subject to any disclaimer, the term of this patent is extended or adjusted under 35 U.S.C. 154(b) by 250 days.

(21) Appl. No.: 11/263,832

(22) Filed: Nov. 2, 2005

(65) Prior Publication Data

US 2006/0112715 A1 Jun. 1, 2006

(30) Foreign Application Priority Data

Nov. 30, 2004 (KR) ..... 10-2004-0099518

(51) Int. Cl.
*F25C 1/12* (2006.01)

(52) U.S. Cl. ..... 62/135; 62/347

(58) Field of Classification Search ..... 62/233, 62/338–356, 135
See application file for complete search history.

(56) References Cited

U.S. PATENT DOCUMENTS 3,146,601 A * 9/1964 Gould ..... 62/3.6
3,151,472 A * 10/1964 Harle et al. ..... 62/391
3,280,578 A * 10/1966 Linstromberg ..... 62/137
3,541,806 A * 11/1970 Jacobs ..... 62/233
4,866,948 A * 9/1989 Cole ..... 62/233
5,297,401 A * 3/1994 Hawco ..... 62/340
5,553,744 A * 9/1996 Sawyer, III ..... 222/64
5,737,932 A * 4/1998 Lee ..... 62/135
6,092,374 A * 7/2000 Kang et al. ..... 62/74
6,938,428 B2 * 9/2005 Onishi et al. ..... 62/135
6,973,803 B2 * 12/2005 Olive et al. ..... 62/338
7,201,005 B2 * 4/2007 Voglewede et al. ..... 62/126

* cited by examiner

*Primary Examiner*—William E Tapolcai
(74) *Attorney, Agent, or Firm*—Birch, Stewart, Kolasch & Birch, LLP

(57) ABSTRACT

An ice making device having a water supply unit for controlling a water supply to an ice making unit, including: a water pipe connected to a water supply source; and a valve member so disposed as to open and shut off the water pipe. The valve member is so disposed as to be controlled in opening and shutting off by a control switch. The water pipe may be so mounted as to be connected to a water supply source outside of a refrigerator, or may be so mounted as to be connected to a water supply tank attachably and detachably equipped inside the refrigerator.

11 Claims, 10 Drawing Sheets

ICE MAKING DEVICE FOR REFRIGERATOR

BACKGROUND OF THE INVENTION

1. Field

The present invention relates to a refrigerator. Particularly, the present invention relates to an ice making device equipped at a freezing chamber of a home refrigerator, and more particularly to an ice making device having a water supply unit.

2. Description of the Related Art

In general, a home refrigerator is disposed with an ice making device for making small ice cubes, also known as ice balls. The ice making device for a conventional home refrigerator includes an ice making unit (200) attachably and detachably disposed at a shelf of a freezing chamber provided at one side of a cooling chamber (R) of the refrigerator (100), as shown in FIG. 1.

The ice making unit (200) includes an ice making tray (210) and an ice making case (220) each separably disposed as illustrated in FIG. 2. The ice making tray (210) is such that an ice making mold (212) is rotatably disposed in a square molded frame (211). The ice making mold (212) is provided with a plurality of partitioned ice making grooves (212*a*) in which small ice cubes can be formed. The ice making mold (212) can be rotated to approximately 180 degrees by the manipulation of a twisting lever (213) to enable to separate and discharge each iced cubes into an ice making case (220).

The ice making device of the conventional refrigerator thus described is operated in such a manner that, when water is supplied for ice making, the ice making tray (210) is dismantled from a shelf of the freezing chamber (F), and water is supplied to and filled into the ice making grooves (212*a*) of the ice making mold (212), or the ice making grooves (212*a*) of the ice making mold (212) is supplied with water via a portable container such as a pot or a kettle.

The ice making device of the conventional refrigerator is such that it is not easy to supply a proper amount of water, causing a frequent overflow or lack of water and decreasing the ice making efficiency and convenience in use.

SUMMARY OF THE INVENTION

The present invention is conceived to solve the afore-mentioned problems and it is an object of the present invention to provide an ice making device having a water supply unit configured to improve a convenience of water supply and an ice making efficiency according to control of optimum amount of water supply.

It is another object of the present invention to provide a refrigerator having an ice making device.

In accordance with one object of the present invention, there is provided an ice making device comprising: an ice making unit disposed at a freezing chamber of a refrigerator; and a water supply unit for supplying an ice making water to the ice making unit.

The water supply unit comprises: a water pipe connected to a water supply source so that water supply nozzles can be arranged adjacent to an upper side of the ice making unit; and a valve member so disposed as to open and shut off the water pipe.

In accordance with another object of the present invention, there is provided a refrigerator comprising a water supply unit for supplying an ice making water to an ice making unit disposed at a freezing chamber, wherein the water supply unit comprises: a water pipe connected to a water supply source so that water supply nozzles can be closely arranged on the ice making unit; and a valve member so disposed as to open and shut off the water pipe.

Preferably, the valve member is so disposed as to be controlled in opening and shutting off by a control switch. More preferably, the valve member is so disposed as to be restrictively controlled in opening time by a timer.

The water pipe may be so mounted as to be connected to a water supply source outside of a refrigerator, or may be so mounted as to be connected to a water supply tank attachably and detachably equipped inside the refrigerator. Preferably, water supply nozzles of the water pipe are so mounted as to be connected to a plurality of branch pipes arranged on the ice making unit, and the water pipe may be mounted with a pump for an easy water supply.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE INVENTION

Figure 1:
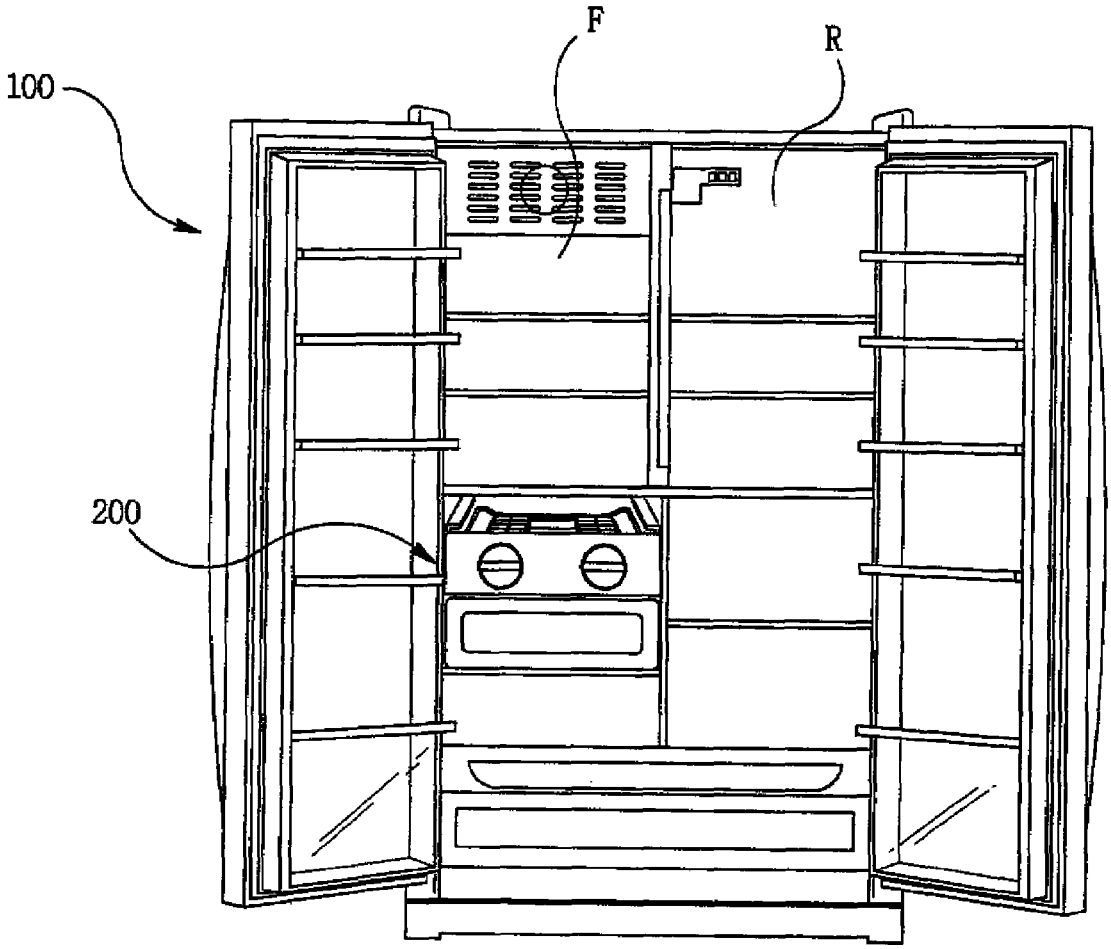
FIG. 1 Prior Art
FIG. 1 is a schematic perspective view of an ice making device in a refrigerator according to the prior art.
Figure 2:
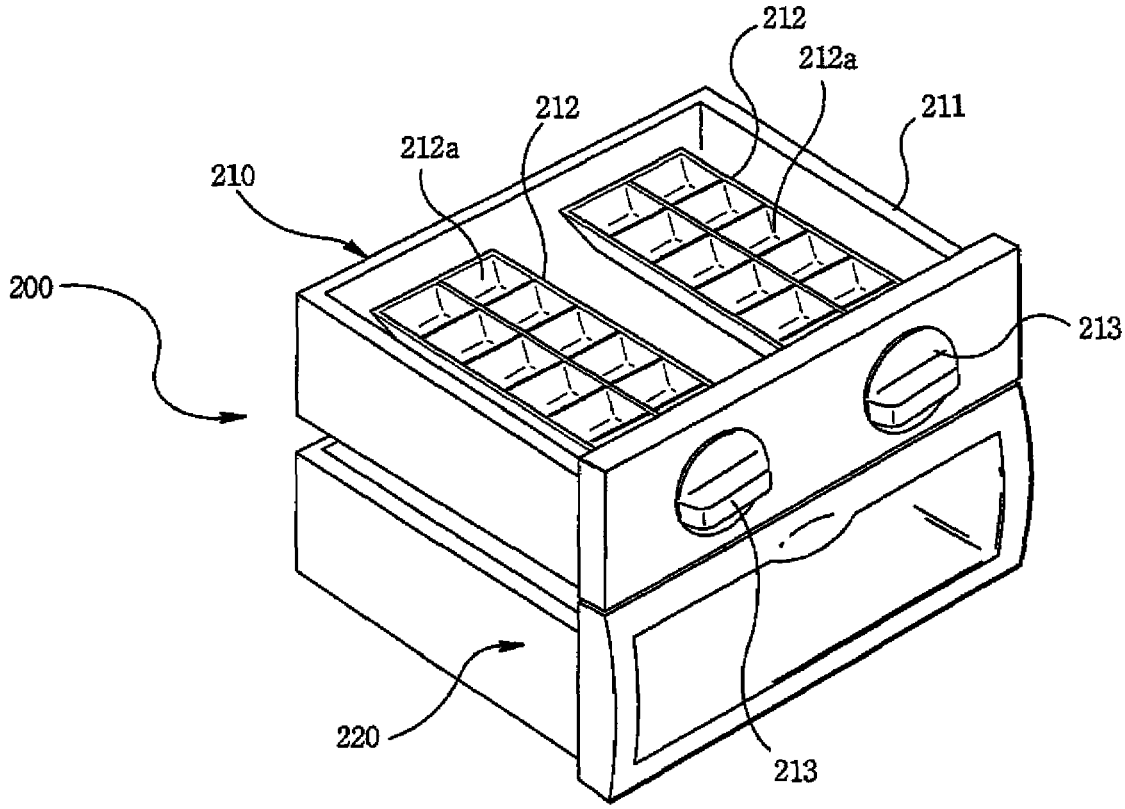
FIG. 2 Prior Art
FIG. 2 is a schematic perspective view of an ice making unit extracted from FIG. 1.
Figure 3:
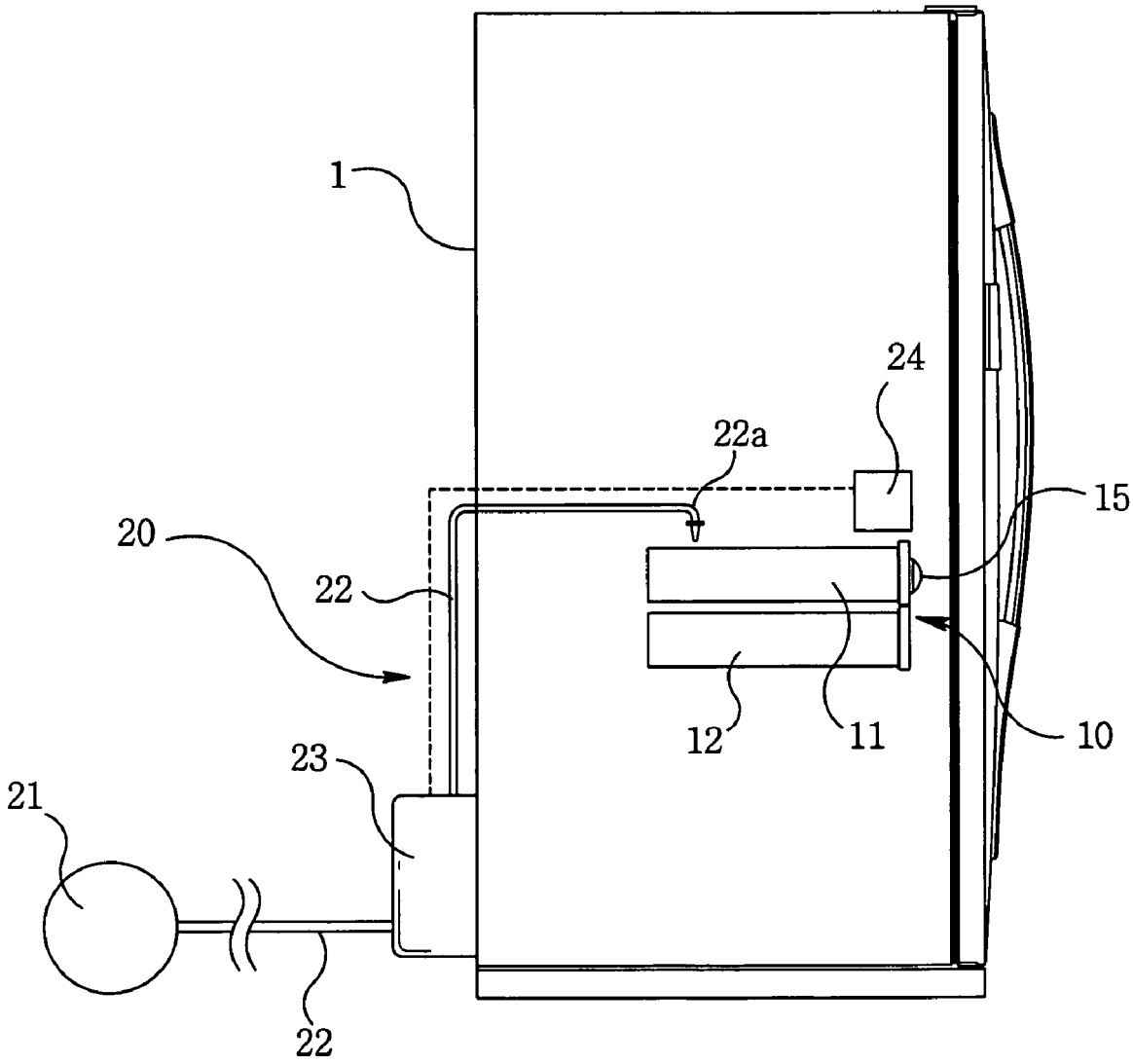
FIG. 3 is a schematic cross-sectional view of an ice making device in a refrigerator according to one embodiment of the present invention.
Figure 4:
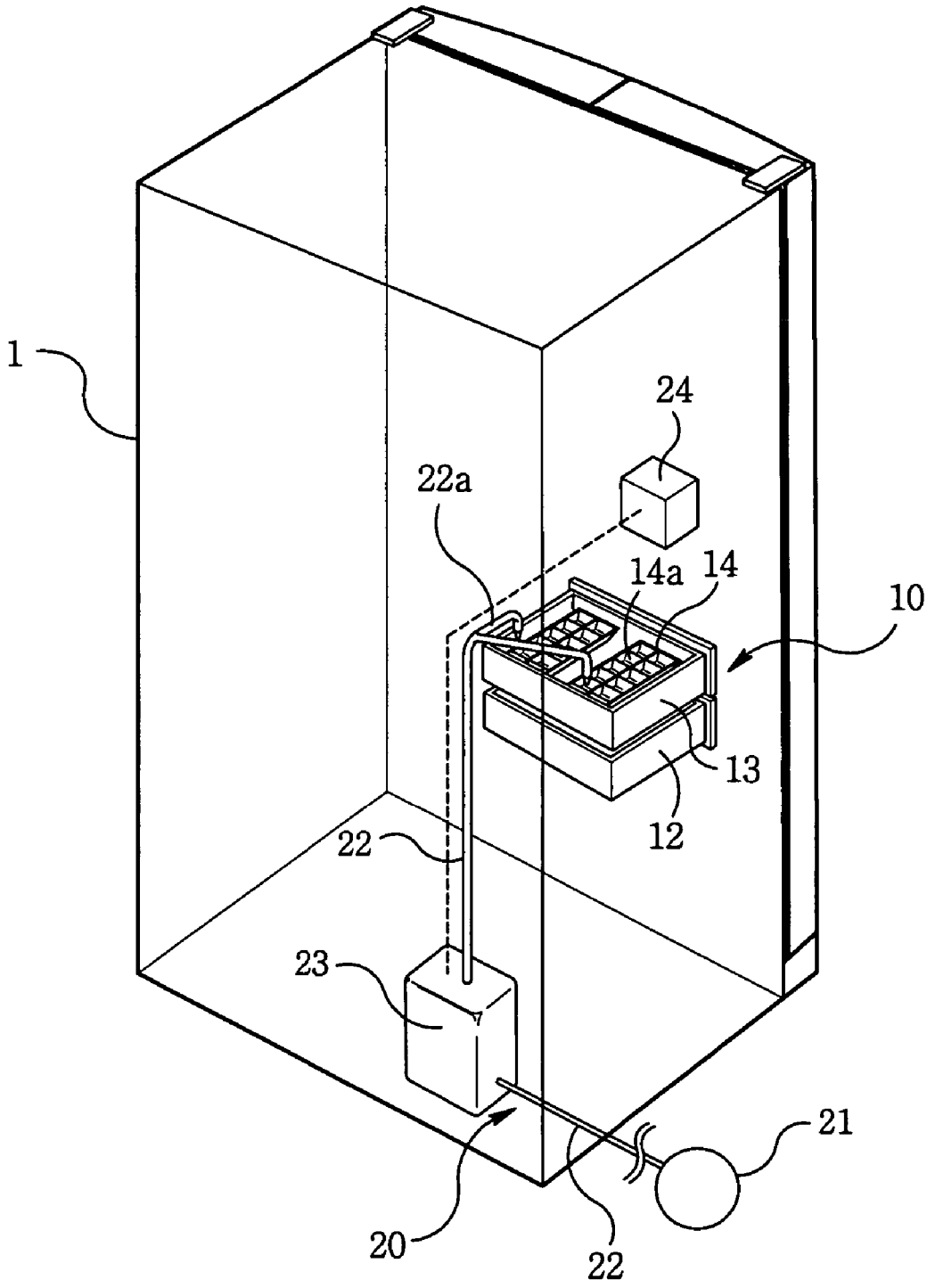
FIG. 4 is a schematic perspective view of an essential part of the ice making device of FIG. 3 projected from the rear side of a refrigerator.

Referring to FIGS. 3 and 4, the ice making device according to the present invention comprises: an ice making unit (10) disposed at a freezing chamber of a refrigerator (10); and a water supply unit (20) for supplying an ice making water to the ice making unit (10).

The ice making unit (10) includes an ice making tray (11) and an ice making case (12) so mounted as to be separated therebetween. The ice making tray (11) is such that an ice making mold (14) is rotatably mounted to a square frame (13). The ice making mold (14) is disposed therein with a plurality of ice making grooves (14*a*) in which small ice cubes are formed. The ice making mold (14) can be rotated to approximately 180 degrees by manipulation of a twisting lever (15) to allow iced cubes to be extracted into the ice making case (12).

The water supply unit (20) comprises: a water pipe (21) connected to a water supply source (21) so that water supply nozzles can be arranged adjacent to an upper side of the ice making mold (14); and a valve member (23) so disposed as to open and shut off the water pipe (22).

Preferably, the valve member (23) is so mounted as to be opened and shut off by manipulation of an electrically connected control switch (24), as shown in FIGS. 3 and 4.

The valve member (23) may control the water supply using, for example, an electrically operated solenoid opened in response to an opening signal and automatically shut off after a predetermined period of time.

As shown in FIGS. 4-6 and 8A-8B, the control switch (24) may be mounted at an external lateral wall of a refrigerator (1) so as to be exposed to the outside, and may be also mounted inside an internal lateral wall of the refrigerator (1).

On the other hand, the valve member (23) may be so constituted as to open and shut off the water pipe (22) via a manual operation of a handle (not shown).

Preferably, the water supply nozzles of the water pipe (22) are further connected to a plurality of branch pipes (22*a*) arranged on the ice making mold (14).

The branch pipes (22*a*) may be applied with a modified embodiment of the present invention so that various shapes of structural arrangement for providing equal water supply to the unit ice making groove (14*a*) of the ice making mold (14).

Figure 5:
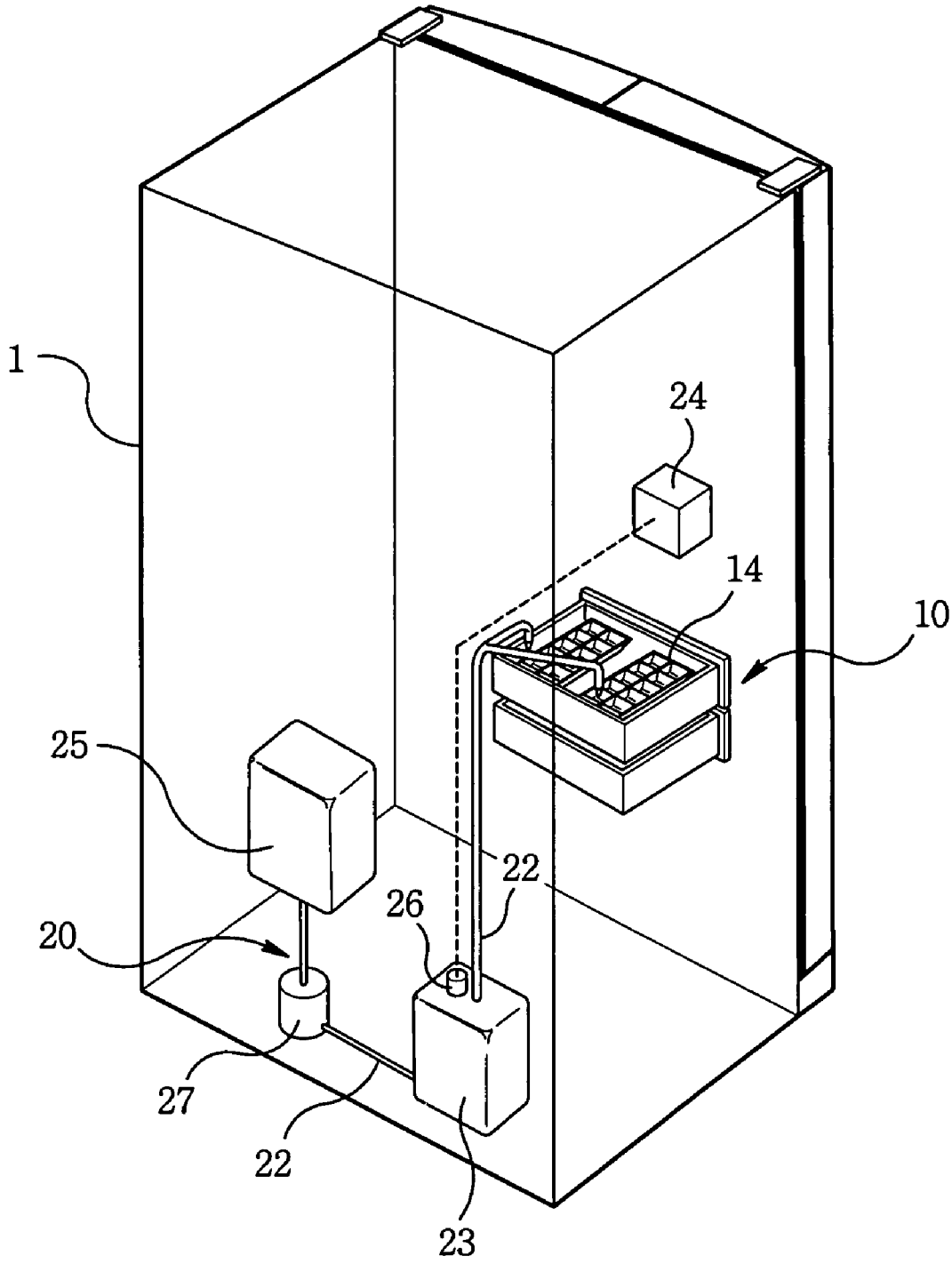
FIGS. 5 and 6 are schematic constitutional views of an ice making device of a refrigerator according to another embodiment of the present invention.
Figure 6:
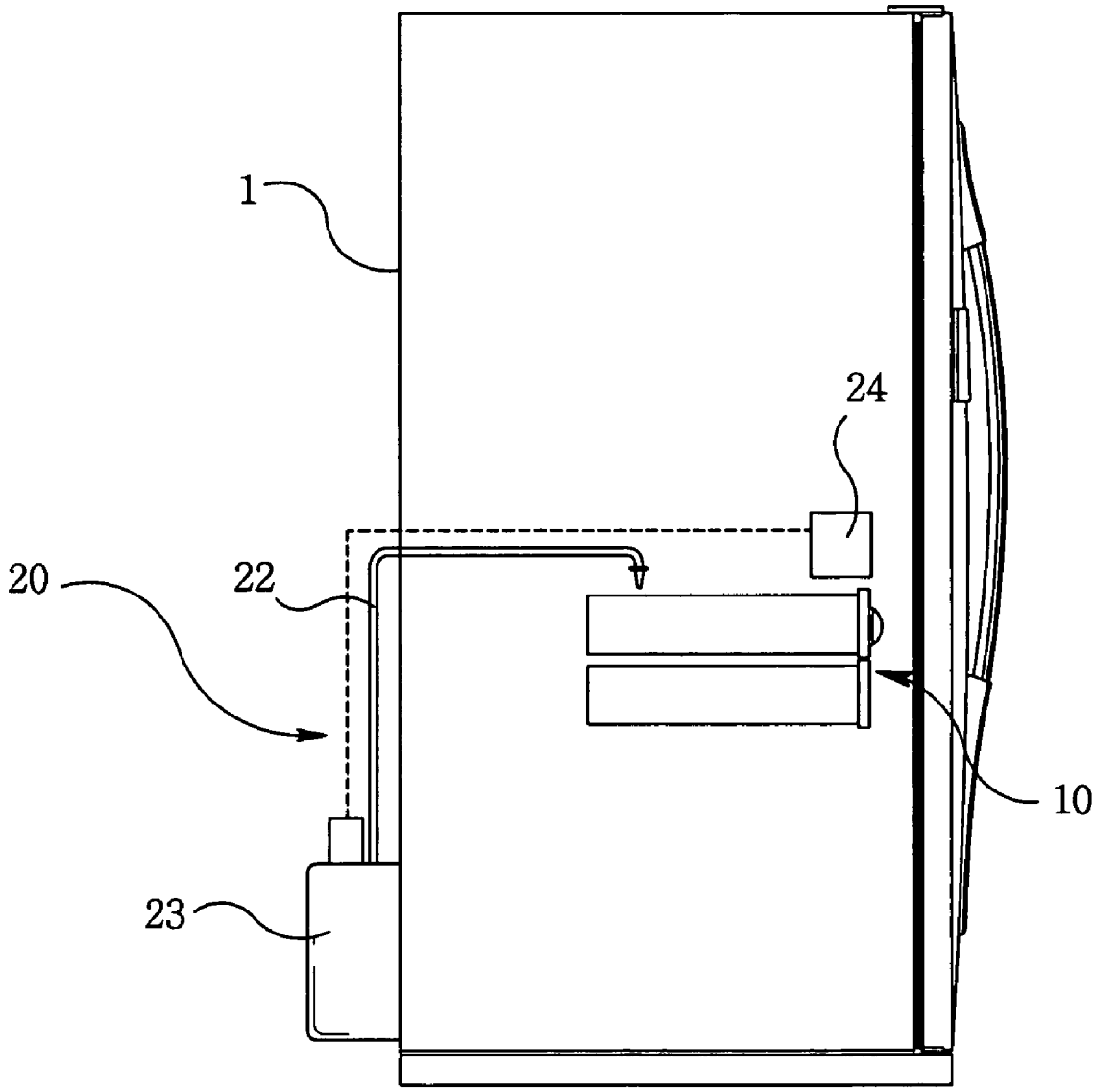

Referring to FIGS. 5 and 6, the water supply unit (20) for supplying water to the ice making mold (14) includes a water pipe (22) connected to a water supply tank (25), a valve member (23), a control switch (24) and a timer (26). Throughout the drawings, like reference numerals denote the like or identical components.

The water supply tank (25) represents a water supply source, and is attachably and detachably mounted inside or outside of the refrigerator (1). Preferably, the water supply tank (25) is mounted on the ice making unit (10) for a smooth water supply operation.

The timer (26) serves to restrictively control an open time of the valve member (23), and the valve member (23) opened by the manipulation of the control switch (24) is so controlled as to be opened for a pre-set period of time by the timer (26) enabling to provide a proper amount of water supply in response to the capacity of the ice making mold (14).

The water pipe (22) may be installed with a pump (27). The pump (27) serving to facilitate a water supply operation if, for example, the water supply tank (25) is mounted underneath the ice making unit (10). The pump (27) is so mounted as to cooperatively operate with the control switch (24) and the timer (26).

Now, an operational process of the ice making device of a refrigerator according to the present invention will be described with reference to the accompanying drawings.

Figure 7A:
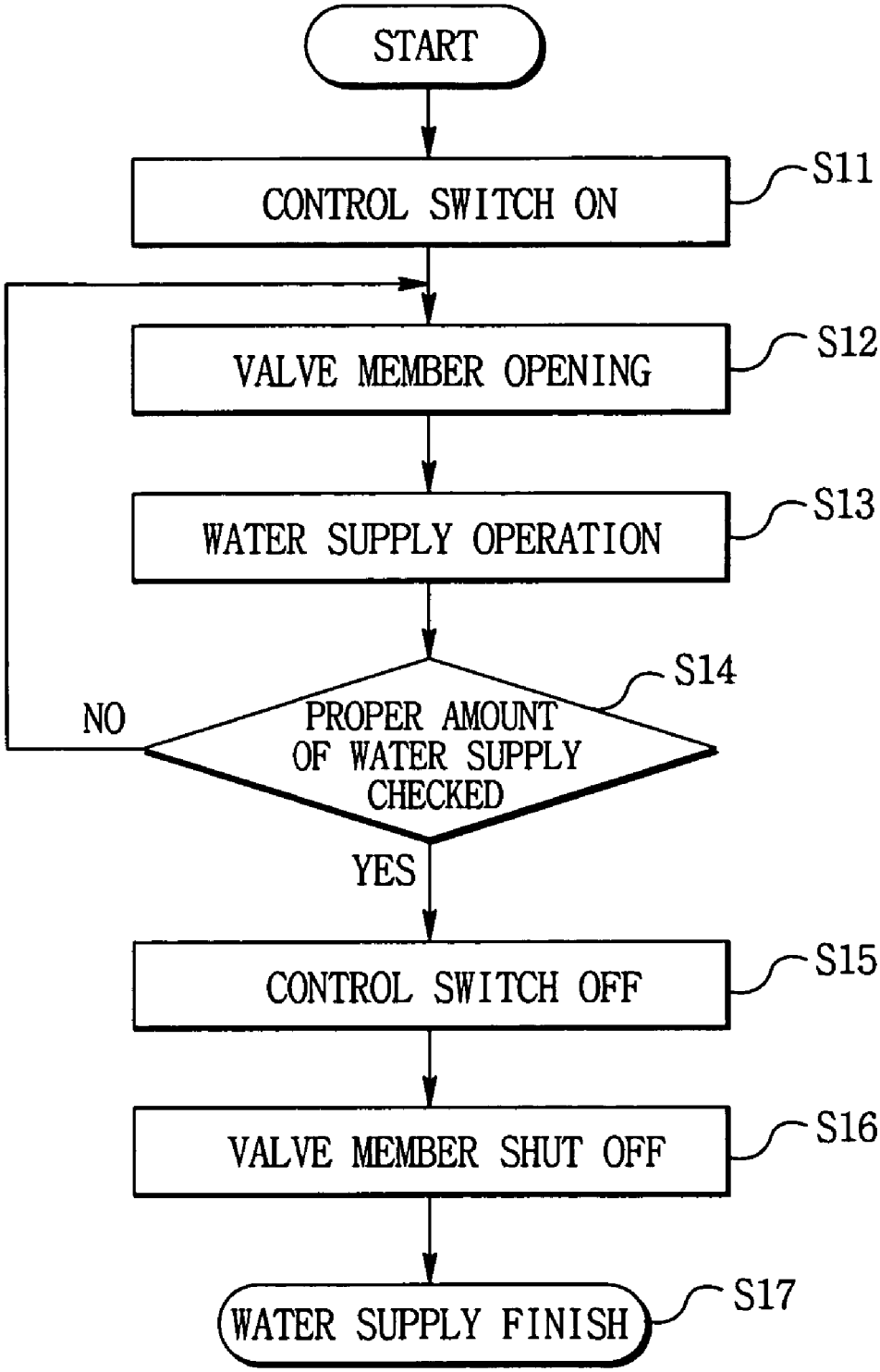
FIGS. 7*a* and 7*b* are flow charts for explaining an operational process in which an ice making device of a refrigerator supplies water through a water supply unit according to the present invention.

FIG. 7*a* is a flow chart for explaining an operational process of an ice making device of a refrigerator according to the embodiment of FIGS. 4 and 5.

First of all, a user manipulates the control switch (24) to an ON state during water supply for ice making (S11).

If the control switch (24) is switched on, the valve member (23) is so operated as to open the water pipe (22) (S12). If the water supply source (21) is always opened, for example, if the water faucet is always opened, water supplied from the water supply source (21) is readily supplied to the ice making mold (14) via the water pipe (22) (S13).

On the other hand, for example, if the water supply source (21) is closed, the water supplied from the water supply source (21) is supplied to the ice making mold (14) via the water pipe (22) by way of the water faucet being opened before or after the ON manipulation of the control switch (24) (S13).

The user checks the state of the water being supplied to the ice making mold (14) (S14). If a proper amount of water is supplied to the ice making mold (14), the user manipulates the control switch (24) to an OFF state (S15). By this, the valve member (23) is so operated as to shut off the water pipe (22) (S16) and the water supplied to the ice making mold (14) is shut off to complete the water supply operation (S17).

Figure 7B:
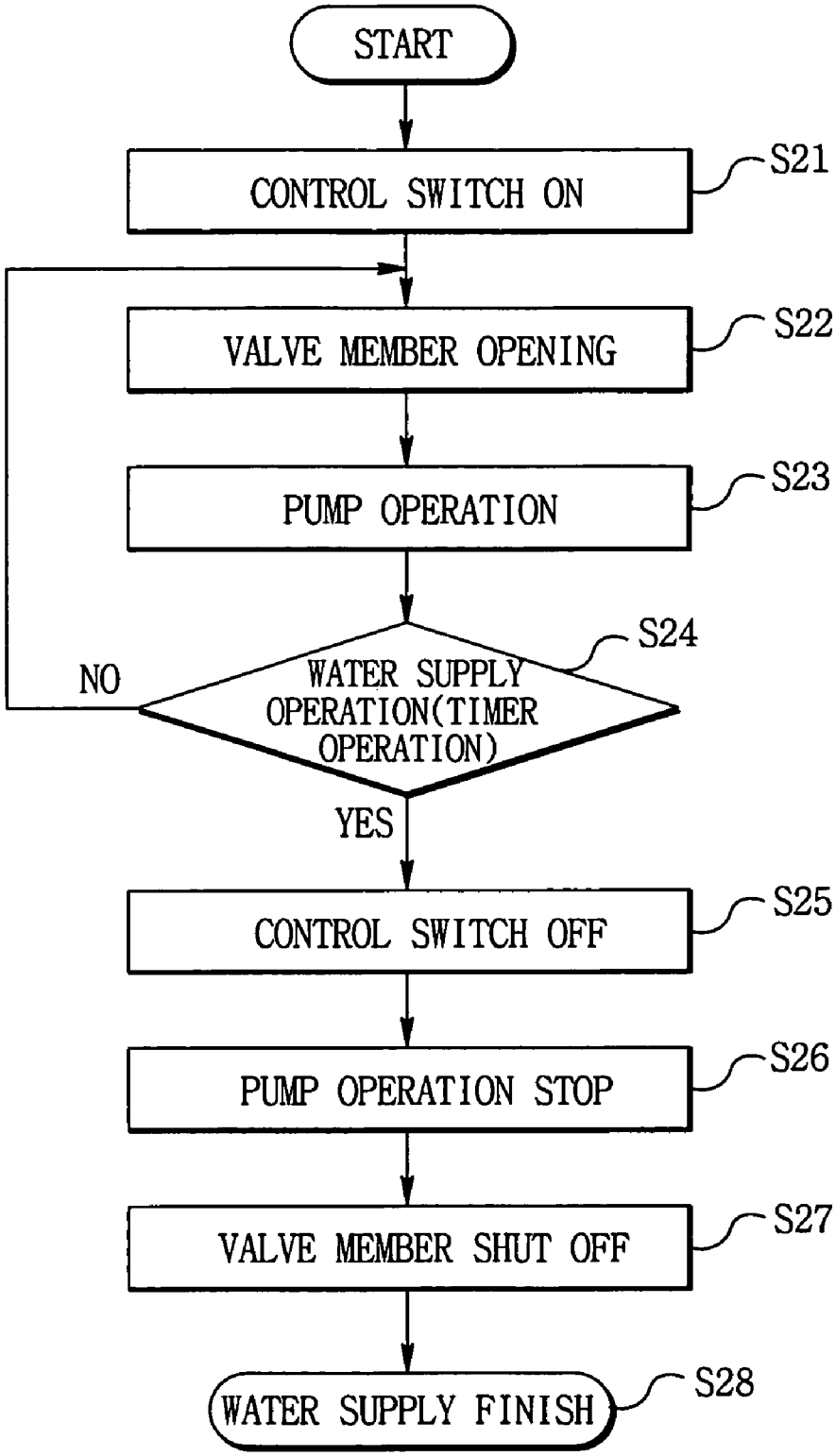
Figure 8A:
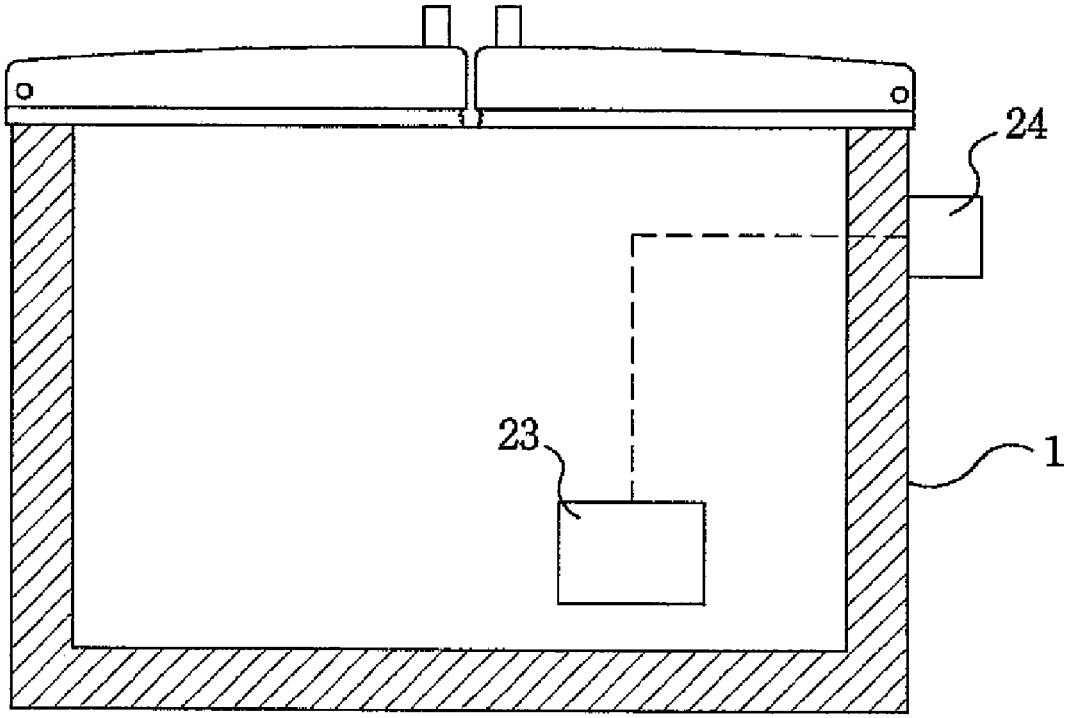
FIGS. 8A-8B show a switch arrangement according to an embodiment of the present invention.
Figure 8B:
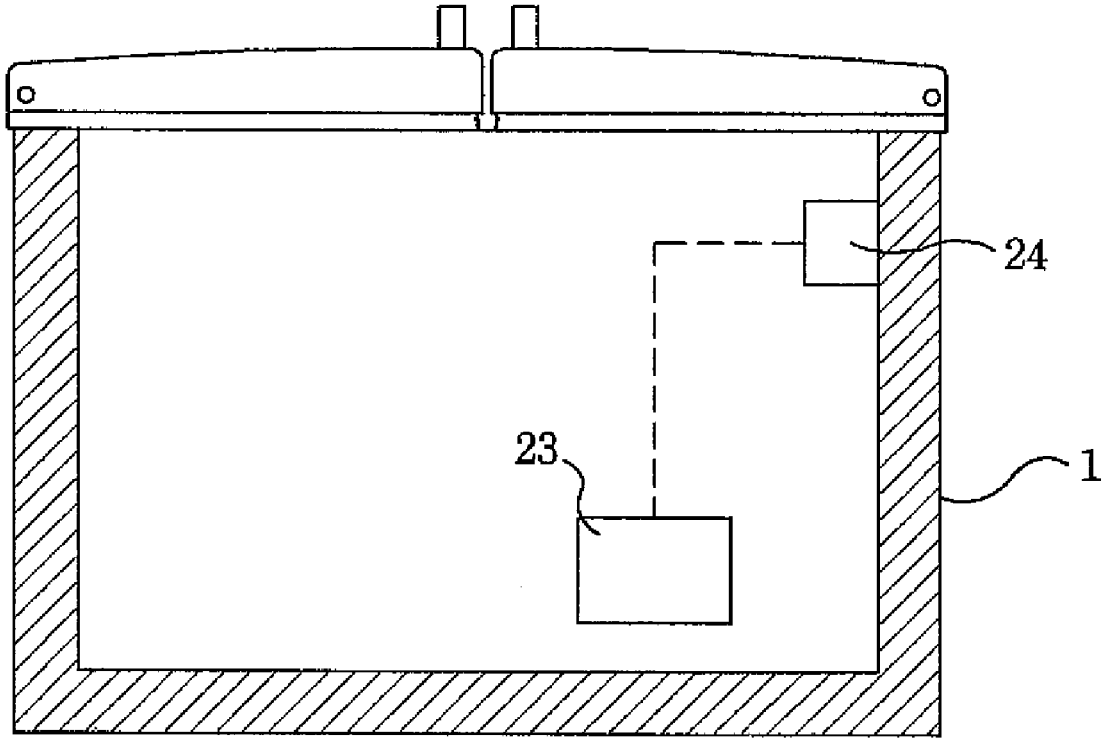

Meanwhile, FIG. 7*b* is a flow chart for explaining an operation process of an ice making device in a refrigerator according to the embodiment in FIGS. 5 and 6.

First of all, a user manipulates the control switch (24) to an ON state during water supply for ice making (S21).

If the control switch (24) is switched on, the valve member (23) is so operated as to open the water pipe (22) (S22). Almost at the same time, the pump (27) is operated (S23) to pump the water stored in the water supply tank (25). The water stored in the water supply tank (25) is supplied to the ice making mold (14) via the opened water pipe (22) (S24). Almost at the same time as the start of pump operation and the water supply operation, the timer (26) is operated for a pre-set period of time. Furthermore, the control switch (24) is operated to return to an OFF state almost at the same time as the completion of the setting time of the timer (26) (S25).

If the control switch (24) is operated to return to the OFF state, the operation of the pump (27) is stopped (S26) and at the same time, the valve member (23) is operated to shut off the water pipe (22) (S27). By this operation, the water supplied to the ice making mold (14) is stopped to complete the water supplying operation (S28).

In other words, in the ice making device according to the embodiments of the present invention, an operating time of the timer (26) is set up in cooperation with water supply capacity in response to the size of the ice making mold (14), such that the ice making operation based on a proper time and proper amount of water supply can be carried out almost automatically in response to one-touch manipulation of the control switch (24) during water supply for ice making.

As apparent from the foregoing, there are advantages in the ice making device of a refrigerator according to the present invention in that water is simply supplied to an ice making unit of the refrigerator to allow a user to conveniently obtain ice cubes, and the ice making device is simply constructed to be easily adapted to a refrigerator.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A refrigerator having a freezing chamber and a refrigeration chamber, comprising:

a front wall and a pair of lateral walls;

an ice making unit disposed in the freezing chamber;

a water supply unit for supplying water to the ice making unit;

a valve member configured to open and shut off the water supply unit; and an ice making control switch mounted on one of the lateral walls of the refrigerator, the ice making control switch configured to control the valve member and being spaced from the valve member, wherein the ice making control switch is mounted on an interior lateral wall of the refrigerator, and wherein the ice making unit further comprises a pump, the ice making control switch controlling the pump.

2. The refrigerator as defined in claim 1, wherein the water supply unit comprises:

a water pipe connected to a water supply source and having water supply nozzles arranged to deliver the water to the ice making unit.

3. The refrigerator as defined in claim 1, further comprising:

a solenoid connected to or within the valve member; and a timer connected to the solenoid.

4. The refrigerator as defined in claim 2, wherein the water supply source is located outside of the refrigerator.

5. The refrigerator as defined in claim 2, wherein the water supply source is located inside the refrigerator.

6. The refrigerator as defined in claim 5, wherein the water supply source is a water supply tank attachably and detachably disposed in the refrigerator.

7. The refrigerator as defined in claim 2, further comprising: a water supply pump connecting the water pipe to the water supply source.

8. The refrigerator as defined in claim 2, wherein the water supply nozzles are connected to a plurality of branch pipes arranged on the ice making unit.

9. The refrigerator as defined in claim 1, further comprising:

an ice making tray disposed in the ice making unit; and an ice making mold rotatably mounted to the ice making tray and having a plurality of ice making grooves, each being partitioned.

10. The refrigerator of claim 1, wherein the ice making control switch controls the opening and closing of the valve member.

11. A refrigerator having a freezing chamber and a refrigeration chamber, comprising:

a front wall and a pair of lateral walls;

an ice making unit disposed in the freezing chamber;

a water supply unit for supplying water to the ice making unit;

a valve member configured to open and shut off the water supply unit; and an ice making control switch mounted on an exterior of one of the lateral walls of the refrigerator, the ice making control switch configured to control the valve member and being spaced from the valve member, wherein the valve member is inside the refrigerator and the ice making control switch is outside the refrigerator.

* * * * *